United States Patent [19]

Kelly

[11] 4,414,739

[45] Nov. 15, 1983

[54] APPARATUS FOR HYDRAULICALLY FORMING JOINTS BETWEEN TUBES AND TUBE SHEETS

[75] Inventor: John W. Kelly, Burbank, Calif.

[73] Assignee: Haskel, Incorporated, Burbank, Calif.

[21] Appl. No.: 218,431

[22] Filed: Dec. 19, 1980

[51] Int. Cl.[3] ..... B23P 15/26

[52] U.S. Cl. ..... 29/727; 29/157.4; 29/157.3 C

[58] Field of Search ..... 29/157.3 C, 727, 157.4

[56] References Cited

U.S. PATENT DOCUMENTS

| | | | |
|---|---|---|---|
| 268,918 | 12/1882 | McIntyre | 29/727 |
| 2,460,580 | 2/1949 | Huber | 29/157.4 |
| 2,479,702 | 8/1949 | Rood | 285/84 |
| 3,977,068 | 8/1976 | Krips | 29/157.4 |
| 4,125,937 | 11/1978 | Brown et al. | 29/157.4 |

FOREIGN PATENT DOCUMENTS

| | | |
|---|---|---|
| 1939105 | 2/1970 | Fed. Rep. of Germany. |
| 2131811 | 12/1972 | Fed. Rep. of Germany. |

*Primary Examiner*—Francis S. Husar
*Assistant Examiner*—V. Rising
*Attorney, Agent, or Firm*—Fulwider, Patton, Rieber, Lee & Utecht

[57] ABSTRACT

A swaging apparatus for expanding a tube disposed within a tube sheet to form a leak-proof joint, the apparatus including a mandrel body for insertion in the tube. The body defines a pair of oppositely directed ramps. A pair of seal members that define the ends of an annular volume within which pressurized hydraulic fluid flows between the mandrel and the tube are movable axially along the ramps, the seals preferably being of the O-ring type. When the mandrel is being inserted, the seals are disposed at the smaller ends of the ramps so as to minimize frictional resistance to the insertion. The seal that is inserted first will tend to move, under frictional forces, to the small end of the ramp, being returned to the large end by the force of the hydraulic fluid during a subsequent swaging operation. The other seal member, however, is urged toward the small end of the corresponding ramp by a spring that is overcome by hydraulic forces once the swaging begins.

18 Claims, 4 Drawing Figures

APPARATUS FOR HYDRAULICALLY FORMING JOINTS BETWEEN TUBES AND TUBE SHEETS

FIELD OF THE INVENTION

The present invention relates to the expansion of tubes within tube sheets to form leak-proof joints and, more particularly, to the use of hydraulic swaging forces to produce such expansion.

BACKGROUND OF THE INVENTION

There are a variety of situations in which it is desired to expand a metal tube radially to form a tight, leak-proof joint. For example, large heat exchangers, particularly the type used as steam generators in nuclear power plants, often employ a tube sheet, which is a metal plate several feet in thickness through which hundreds of stainless steel or carbon steel tubes must pass. The tube sheet is fabricated with through bores of a suitable diameter in which the tubes are inserted. The tubes are then expanded against the sides of the bores by plastic deformation to seal the small crevices that would otherwise exist around the tubes. If these crevices were allowed to remain, they could collect corrosive agents, and would, therefore, decrease the predictable life-expectancy of the equipment.

Older techniques for expanding the tubes to form the desired leak-proof joints relied upon roller swaging. However, mechanical rolling of the interior surface of the tube causes a decrease in the thickness of the tube wall. In addition, roller swaging is a time-consuming process and it is sometimes difficult or impossible, particularly in the case of small diameter tubes, to obtain the swaging pressures desired.

More recently, superior tube and tube sheet joints have been formed by hydraulic swaging. In accordance with this technique, a mandrel is inserted in the tube and a pressurized working fluid is introduced through the mandrel into a small annular space between the mandrel and the tube. The fluid is axially confined between seals and applies high outwardly directed radial pressure to the tube wall.

O-rings are usually used for the seals. In the case of high-pressure applications, it is desirable to use O-rings in combination with back-up members of a stiffer material such as polyurethane, as explained in this inventor's co-pending application, Ser. No. 133,013 filed on Mar. 24, 1980, and entitled SELF-CENTERING SEAL FOR USE IN HYDRAULICALLY EXPANDING TUBES now U.S. Pat. No. 4,359,889, issued Nov. 23, 1982.

O-rings employed in this environment must have a sufficient diameter and rigidity to effectively confine the hydraulic fluid in the desired manner. When an O-ring of suitable size and properties is inserted in a tube it offers very high frictional resistance, binding against the interior tube surface. Insertion of the mandrel is therefore difficult and time-consuming. Remembering that large numbers of tubes are often installed in a single tube sheet, the difficulties attributable to frictional O-ring resistance to mandrel insertion is a major factor bearing upon the efficiency and effectiveness of hydraulic swaging techniques that have been employed.

A principal objective of the present invention is to provide a swaging apparatus and method for forming joints between tubes and tube sheets in which the resistance offered by the seals as the mandrel is inserted in the tube is greatly reduced, although the effectiveness of the seals is not diminished.

SUMMARY OF THE INVENTION

The present invention relates to an apparatus and method that accomplishes the above objective by the use of ramps that permit a seal member to expand and contract radially while moving axially. This arrangement permits the seal member to be contracted for purposes of insertion of a mandrel.

In one form of the invention, a single mandrel employs two similar seal members, preferably O-rings, that define opposite ends of a volume in which pressurized hydraulic fluid flows between the mandrel and the tube to produce radial expansion of the tube. The seal member that is inserted first is referred to as the inner seal member, while the other seal member is referred to as the outer seal member.

The ramps can be so arranged that they taper radially inwardly toward each other. Thus, the ramp that carries the inner seal member tapers inwardly toward a mandrel head through which hydraulic fluid can be supplied via a passage extending along the mandrel body. Accordingly, the insertion of the mandrel tends to force the inner seal member to move toward the small end of the corresponding ramp so that its diameter is reduced and interference by the seal member with the insertion of the mandrel is minimized. Accordingly, this inner seal member and ramp combination does not include any arrangement for biasing the seal member toward the larger end of the ramp and the seal member is freely movable except for frictional forces. The seal member should, however, be so constructed that when it is disposed at the smaller end of the ramp, it has a sufficient diameter to lightly engage the interior surface of the tube. Hydraulic fluid then will not flow past the seal member but will instead force the seal member to move up the ramp into tighter engagement with the tube as the pressure increases.

In the case of the outer seal member, the ramp is so arranged that its smaller end is inserted in the tube first. The corresponding seal member is, therefore, urged toward the larger end of the ramp and will tend to bind against the inner surface of the tube as in previously known mandrel construction. To overcome this difficulty, means are provided for urging the outer seal member toward the smaller end of the ramp. When fluid pressure is applied, after insertion, the seal member moves back up the ramp to tightly engage the inner surface of the tube. A preferred arrangement for urging the seal member toward the smaller end of the ramp employs a spring, which may be a coil spring, that surrounds the mandrel body and acts on the seal member through a sleeve that is axially slidable on the mandrel body.

It is desirable, particularly where high pressures are encountered, to provide a back-up member of a stiffer material on the low pressure side of each of the above-mentioned O-ring seal members. In the case of the outer seal member, this back-up seal member can be carried on the outside of the sleeve by which the spring biasing force is transmitted.

Another aspect of the present invention relates to a method applicable to the use of the apparatus described above. According to this method, the inner seal member is maintained at the smaller end of the corresponding ramp by frictional forces as the mandrel is inserted in the tube, the seal member being freely movable on the ramp except for frictional forces. The force of hydraulic fluids supplied through the mandrel is then relied upon to move the seal member toward the larger end of the ramp as the hydraulic fluid pressure increases.

Other features and advantages of the present invention will become apparent from the following detailed description taken in conjunction with the accompanying drawings, which illustrate, by way of example, the principles of the invention.

DETAILED DESCRIPTION

Figures 1, 2, 3, 4:
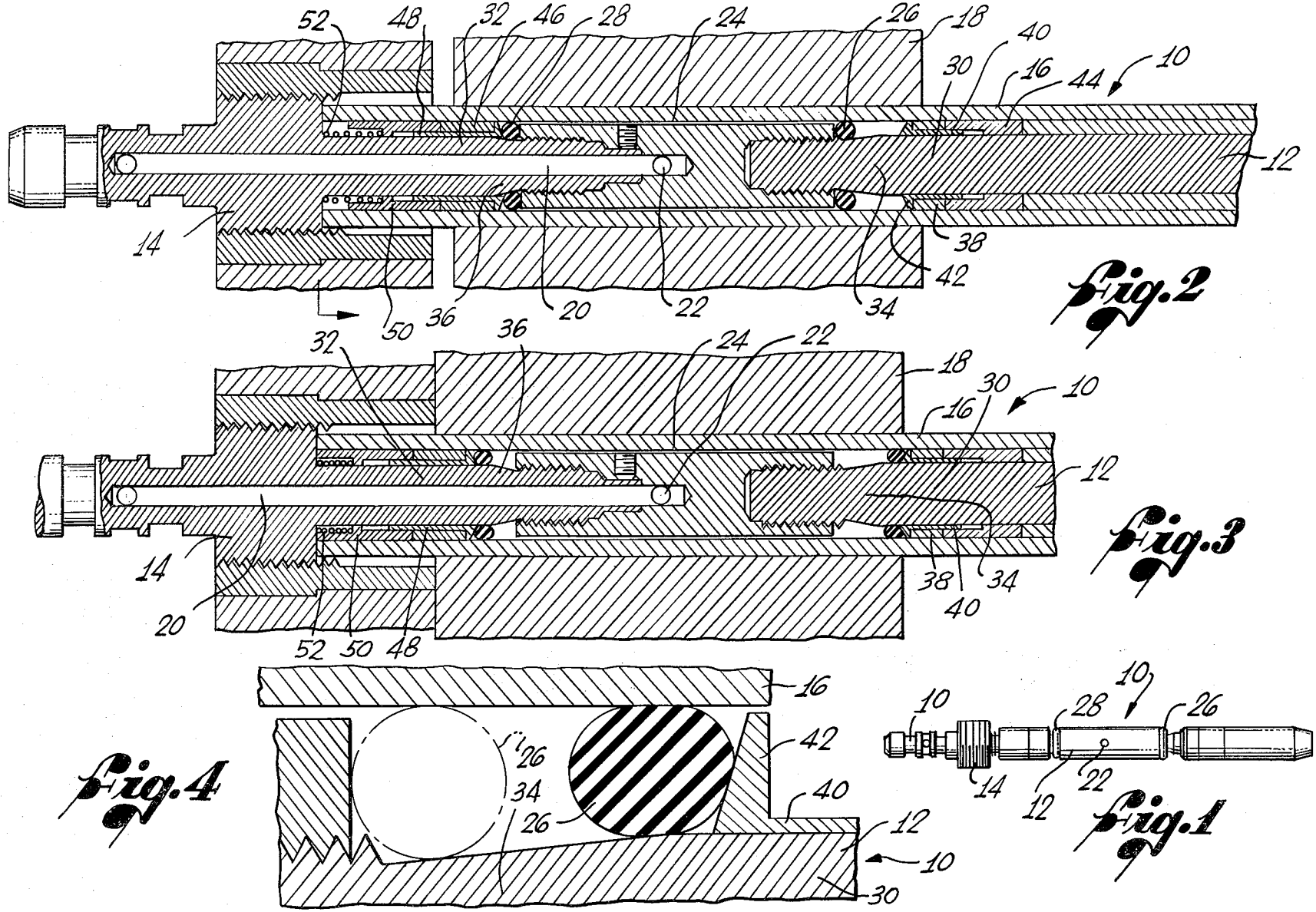
FIG. 1 is a plan view of a mandrel constructed in accordance with the present invention.
FIG. 2 is an enlarged, longitudinal, cross-sectional view, showing the mandrel after it has been fully insert in a tube sheet.
FIG. 3 is a similar longitudinal, cross-sectional view, showing the mandrel after it has been fully inserted in the tube and hydraulic pressure has been applied.
FIG. 4 is a further enlarged fragmentary cross-sectional view showing the inner seal member in solid lines in its operational position and in phantom lines in its insertion position.

A mandrel 10 shown in FIGS. 1 through 4 of the accompanying drawings includes an elongated generally cylindrical mandrel body 12 and a head 14. It is inserted in a tube 16, as shown in FIGS. 2 and 3, that is in turn positioned in a bore in a tube sheet 18. Once the mandrel 10 is in place, as shown in FIG. 3, pressurized hydraulic fluid, preferably water, is supplied through an axial passageway 20 in the mandrel body 12 that is continued by a cross-bore 22, permitting hydraulic fluid to enter an elongated annular volume 24 between the mandrel body 12 and the interior surface of the tube 16. The outer boundaries of this volume 24 are defined at opposite ends by an inner seal member 26 and an outer seal member 28, both seal members being O-rings that encircle the mandrel body 12.

The seal members 26 and 28, when in their operational positions shown in FIG. 3 and in solid lines in FIG. 4, are positioned on portions 30 and 32 of the mandrel body that are of reduced diameter. Adjacent to each of these reduced-diameter portions 30 and 32 is an inwardly tapered conical ramp section 34, 36.

The inner seal 26 and corresponding ramp 34 will be considered first. This inner ramp 34 is tapered so that its diameter decreases in the direction of the outer seal 28 and the head 14. The inner seal 26 is freely movable on the ramp 34, except for frictional forces.

As the mandrel 10 is inserted in the tube 16, frictionnal engagement of the inner seal member 26 with the interior surface of the tube 16 pushes the seal member downwardly along the ramp 34 toward the head 14, as shown in FIG. 2. This frictional force will retain the inner seal member at the smaller end of the ramp 34 (as shown in FIG. 2 and in phantom lines in FIG. 4) until the mandrel 10 has been fully inserted (as shown in FIG. 3).

The inner O-ring seal 26 is so dimentioned that when it is disposed at the smaller end of the ramp 34, its outside diameter is large enough to lightly engage the inner surface of the tube 16, as best shown in phantom lines in FIG. 4. Thus, when hydraulic fluid enters the volume 24, it cannot readily pass the inner seal member 26 and the seal member is forced up the ramp 34 by the hydraulic pressure until it reaches the untapered reduced-diameter portion 30 of the mandrel body where it comes to rest, as shown in FIG. 3 and in solid lines in FIG. 4.

In this embodiment, the mandrel 10 is constructed to operate at an unusually high pressure at which the O-ring 26 could fail. An annular ring-shaped inner back-up member 38 is, therefore, provided which encircles the mandrel body 12 on the low pressure side of the O-ring 26. The back-up member 38 is made of polyurethane, and at high pressure, such as 30,000 psi, it behaves as a liquid, although it retains a memory and returns to its original shape when the pressure is released.

The back-up member 38 encircles and rides on a sleeve 40 that in turn is slidable on the mandrel body 12. The sleeve 40 includes a flange 42 on its leading edge that separates the O-ring seal member 26 from the back-up member 38. At the opposite side of the back-up member 38 is an abutment piece 44 that positions the back-up member 38 and is undercut to permit limited axial movement of the sleeve 40. One function of the sleeve 40 is to insure symetrical radial expansion of the back-up member 38, in a manner explained in the above-mentioned co-pending application Ser. No 133,010 of the present inventor.

At the opposite end of the volume 24 within which the hydraulic fluid is confined, an additional problem is created with respect to the interaction of the outer O-ring seal member 28 with its corresponding ramp 36. The diameter of this outer ramp 36 decreases in a direction proceeding away from the head 14. Accordingly, when the mandrel 10 is inserted in the tube 12, the frictional forces developed between the O-ring 28 and the inner surface of the tube 16 tend to force the O-ring toward the larger end of the ramp 36 with resulting interference with the insertion of the mandrel 10.

Before turning to the manner in which this problem is overcome, it should be noted that the outer O-ring seal member 28, like the inner O-ring 26, encircles an outer sleeve 48. An abutment member 50 disposed on the opposite side of the back-up member 46 from the outer O-ring 28 is undercut from both ends. On one end the undercut receives the axially slidable sleeve 48, whereas the other end receives a coil spring 52 that surrounds the mandrel body 12. The abutment piece 50 is slidable on the mandrel body 12 and is urged away from the head 14 by the spring 52.

When the mandrel 10 is being inserted in the tube 12, the force of the spring 52 is sufficient to overcome the frictional forces acting on the outer O-ring 28 and to retain that O-ring at the smaller end of the outer ramp 36. As in the case of the inner O-ring 26, the outer O-ring 28 has a large enough outside diameter that it lightly engages the interior surface of the tube 16. Thus, when hydraulic fluid is introduced to the annular volume 24, that fluid cannot pass the outer O-ring 28. Instead, it overcomes the force of the spring 52 and moves the outer O-ring 28 axially along the mandrel body 10 to the larger end of the ramp 36. The O-ring 28 then forms a tight leak-proof seal against the tube and transmits the force of the hydraulic fluid to the back-up member 46.

It will be understood, in light of the foregoing, that the present invention provides a unique and improved mandrel which can be readily inserted in a tube without the need to overcome large frictional forces. Nevertheless, the effectiveness of the seals in containing the hydraulic fluid is not diminished.

While a particular form of the invention has been illustrated and described, it will be apparent that various modifications can be made without departing from the spirit and scope of the invention.

I claim:

1. A swaging apparatus for expanding a tube disposed within a tube sheet to form a joint, said apparatus comprising:

a mandrel body for insertion in said tube;

inner and outer seal members carried by said body at axially spaced-apart locations to define a volume between said body and said tube bounded at opposite ends by said seal;

a ramp defined by said body and tapered radially inwardly toward said inner seal member, said ramp being adapted to permit said outer seal member to move therealong toward said inner seal member, thereby allowing said outer seal member to slide along said tube with reduced frictional forces as said mandrel body is inserted; and means for urging said outer seal member to move axially toward said inner seal member as said mandrel body is inserted in said tube.

2. The apparatus of claim 1 wherein said means for urging said outer seal member is a spring.

3. The apparatus of claim 2 wherein said seal members and said spring encircle said mandrel body.

4. The apparatus of claim 3 wherein said ramp is conical.

5. The apparatus of claim 1 wherein said seal members are O-rings.

6. A joint-forming apparatus for hydraulically expanding a tube disposed within a bore in a tube sheet, said apparatus comprising:

an elongated mandrel body for insertion in said tube so as to define a volume between said body and said tube;

a fluid passage extending axially through a portion of said body and opening into said volume, whereby hydraulic fluid can be supplied under pressure to expand said tube radially;

a head attached to one end of said body through which fluid can be admitted to said passage;

a ramp defined by said body and tapered radially inwardly toward said head;

a radially expandable seal member encircling said body and movable axially along said body on said ramp; and means for urging said seal member along said ramp toward said head to reduce frictional forces caused by the engagement of said seal member with the inside of said tube during insertion of said mandrel.

7. The apparatus of claim 6 wherein said seal member is an O-ring.

8. The apparatus of claim 6 wherein said means for urging said seal member includes:

a sleeve movable along said body and engagable with said seal member; and resilient means for urging said sleeve toward said seal member.

9. The apparatus of claim 8 wherein said resilient means comprises a coil spring that encircles said body.

10. The apparatus of claim 6 wherein said ramp is conical.

11. The apparatus of claim 6 comprising:

a sleeve axially slidable along said body and disposed adjacent to said seal member; and a back-up member that is more rigid than said seal member and is adapted to cooperate with said seal member to confine said hydraulic fluid at high pressure, said back-up member surrounding and riding on said sleeve;

said means for urging said seal member being a coil spring that encircles said body and acts on said seal member through said sleeve.

12. A swaging apparatus for expanding a tube disposed within a tube sheet to form a leak-proof joint comprising:

an elongated mandrel body;

inner and outer seal members carried by said body at axially spaced-apart locations to define an annular volume between said body and said tube bounded at opposite ends by said seal members;

an outer ramp defined by said body and tapered radially inwardly toward said inner seal member, said outer ramp being adapted to permit said outer seal member to move therealong toward said inner seal member, thereby reducing frictional forces resulting from the engagement of said outer seal member with said tube as said mandrel body is inserted;

an inner ramp defined by said body and tapered radially inwardly toward said outer seal member, said inner ramp being adapted to permit said inner seal member to move therealong toward said outer seal member, thereby reducing frictional forces resulting from the engagement of said inner seal member with said tube as said mandrel body is inserted; and means for urging said outer seal member axially along said outer ramp toward said inner seal member as said mandrel body is inserted in said tab.

13. The apparatus of claim 12 wherein said inner seal member is axially movable on said inner ramp, restrained only by frictional forces.

14. The apparatus of claim 12 wherein:

said mandrel body is generally cylindrical;

said seal members encircle said body; and said ramps are conical.

15. The apparatus of claim 12 wherein said seal members are O-rings.

16. A swaging apparatus for expanding a tube within a tube sheet to form a joint comprising:

an elongated mandrel body;

a seal member carried by said body to define a boundary of a volume between said body and said tube;

a ramp defined by said body and tapered radially inwardly, said ramp being adapted to permit said seal member to move axially therealong, restrained by frictional forces only as said body is inserted in said tube, thereby reducing frictional forces resulting from the engagement of said seal member with said tube as said mandrel body is inserted in said tube.

17. The apparatus of claim 16 wherein:

said body is generally cylindrical;

said seal member encircles said body; and said ramp is conical.

18. The apparatus of claim 16 wherein said seal members are O-rings.

* * * * *